US008655221B2

(12) United States Patent
Okabe

(10) Patent No.: US 8,655,221 B2
(45) Date of Patent: Feb. 18, 2014

(54) MOUNTABLE CARTRIDGE WITH PROTRUDING MEMBER

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 340 days.

(21) Appl. No.: 12/975,345

(22) Filed: Dec. 21, 2010

(65) Prior Publication Data

US 2011/0159970 A1 Jun. 30, 2011

(30) Foreign Application Priority Data

Dec. 24, 2009 (JP) ..... 2009-293468

(51) Int. Cl.
*G03G 21/16* (2006.01)
*G03G 15/00* (2006.01)

(52) U.S. Cl.
USPC ..... 399/111; 399/167

(58) Field of Classification Search
USPC ..... 399/111, 117, 119, 167
See application file for complete search history.

(56) References Cited

U.S. PATENT DOCUMENTS

| | | | | |
|---|---|---|---|---|
| 2003/0053823 | A1 | 3/2003 | Cho et al. | |
| 2007/0059038 | A1 | 3/2007 | Shiraki | |
| 2008/0152388 | A1 | 6/2008 | Ueno et al. | |
| 2008/0260428 | A1 * | 10/2008 | Ueno et al. | 399/167 |

FOREIGN PATENT DOCUMENTS

| | | | |
|---|---|---|---|
| JP | 2003-120713 | A | 4/2003 |
| JP | 2004-117988 | A | 4/2004 |
| JP | 2006-276529 | A | 10/2006 |
| JP | 2007-079139 | A | 3/2007 |
| JP | 2008-233867 | A | 10/2008 |
| JP | 2009-134284 | A | 6/2009 |
| WO | 2008081966 | A1 | 7/2008 |

OTHER PUBLICATIONS

State Intellectual Property Office of the People's Republic of China, The First Office Action for Chinese Patent Application No. 201010623212.7 (counterpart Chinese patent application), mailed Jul. 23, 2012.

State Intellectual Property Office of the People's Republic of China, The Second Office Action for Chinese Patent Application No. 201010623212.7 (counterpart to above-captioned patent application), mailed Apr. 11, 2013.

Japan Patent Office, Notice of Reasons for Rejection for Japanese Patent Application No. 2009-293468 (counterpart to above-captioned patent application), mailed Jun. 18, 2013.

State Intellectual Property Office of the People'S Republic of China, Decision of Rejection for Chinese Patent Application No. 201010623212.7 (counterpart to above-captioned patent application), mailed Oct. 28, 2013.

* cited by examiner

*Primary Examiner* — Hoang Ngo
(74) *Attorney, Agent, or Firm* — Baker Botts L.L.P.

(57) ABSTRACT

A cartridge includes a casing, a rotatable member rotatably supported by the casing, a protruding member configured to advance and retract in directions parallel to an axis of rotation of the rotatable member, and an urging member configured to urge the protruding member to advance in an advancing direction. The protruding member has a particular sloping surface configured to be contacted in a direction orthogonal to an axis of rotation of the protruding member when the cartridge is mounted. The particular sloping surface slopes with respect to directions parallel to and orthogonal to the axis of rotation of the protruding member.

15 Claims, 20 Drawing Sheets

MOUNTABLE CARTRIDGE WITH PROTRUDING MEMBER

CROSS-REFERENCE TO RELATED APPLICATIONS

The present application claims priority to and the benefit of Japanese Patent Application No 2009-293468, which was filed on Dec. 24, 2009, the disclosure of which is incorporated herein by reference in its entirety.

BACKGROUND OF THE INVENTION

1. Field of the Invention

The present invention relates to a cartridge mountable into and demountable from the body of an image-forming apparatus.

2. Description of the Related Art

It is known that some image-forming apparatuses, such as laser printers, include cartridges that are demountably mounted in the bodies thereof (see Japanese Unexamined Patent Application Publication No. 2007-79139, for example).

Such cartridges house rotatable members such as a photoconductor drum on which an electrostatic latent image is to be formed and a development roller that supplies toner onto the peripheral surface of the photoconductor drum. In a case of a development cartridge, a rotatable member is positioned with part of the peripheral surface thereof exposed from the casing of the development cartridge. The cartridge is mounted in an apparatus body such that the part of the peripheral surface of the rotatable member exposed from the casing is positioned on the rear side in the apparatus body.

Such a cartridge has on one side thereof a gear cover. The gear cover has an insertion hole. In a state where the cartridge is mounted in the apparatus body, the tip of the input gear significantly protrudes from the insertion hole of the gear cover, whereby the input gear is connected to a driving gear provided in the apparatus body. Thus, a driving force for driving the rotatable member, such as a photoconductor drum or a development roller, is input from the driving gear to the input gear.

Specifically, a guide wall that guides the cartridge is provided in the apparatus body. The guide wall is angled such that the rear side thereof is near the cartridge. The guide wall has a through-hole at a position thereof facing the driving gear.

The cartridge is provided with a coil spring that urges the input gear toward the outside in the axial direction of the rotatable member. The input gear constantly receives the urging force of the coil spring. Therefore, the tip of the input gear significantly protrudes from the insertion hole of the gear cover.

When the cartridge starts to be mounted into the apparatus body, the tip of the input gear comes into contact with the guide wall. When the cartridge is further moved into the apparatus body, the guide wall narrows, and as the cartridge is guided by the angled guide wall, the input gear retracts into the cartridge. When the mounting of the cartridge into the apparatus body is completed, the input gear faces the through-hole of the guide wall. Then, the input gear receiving the urging force of the coil spring moves outward in the axial direction, passes the through-hole and the insertion hole, and protrudes toward the driving gear. Consequently, the input gear is connected to the driving gear.

SUMMARY OF THE INVENTION

In the above case, however, a space for providing the guide wall is necessary in the apparatus body. This increases the size of the apparatus body. Moreover, to avoid interferences between the guide wall and other components in the apparatus body, the configuration inside the apparatus body may become complicated.

It is an object of the present invention to provide a cartridge in which a protruding member is advanceable and retractable with a configuration.

[Independent Claims]

Thus, the protruding member is configured to be advanceable and retractable with a configuration utilizing the particular sloping surface of the protruding member without providing in the apparatus body any additional members for causing the protruding member to advance and retract, whereby engagement between the protruding member and the driving member is realized.

DETAILED DESCRIPTION OF THE EMBODIMENTS

Embodiments of the present invention, and their features and advantages, may be understood by referring to FIGS. 1-16, like numerals being used for like corresponding parts in the various drawings. Embodiments of the invention, as described below, are merely exemplary embodiments, and the embodiments may be altered within the scope of the invention.

1. Laser Printer

Figure 1:
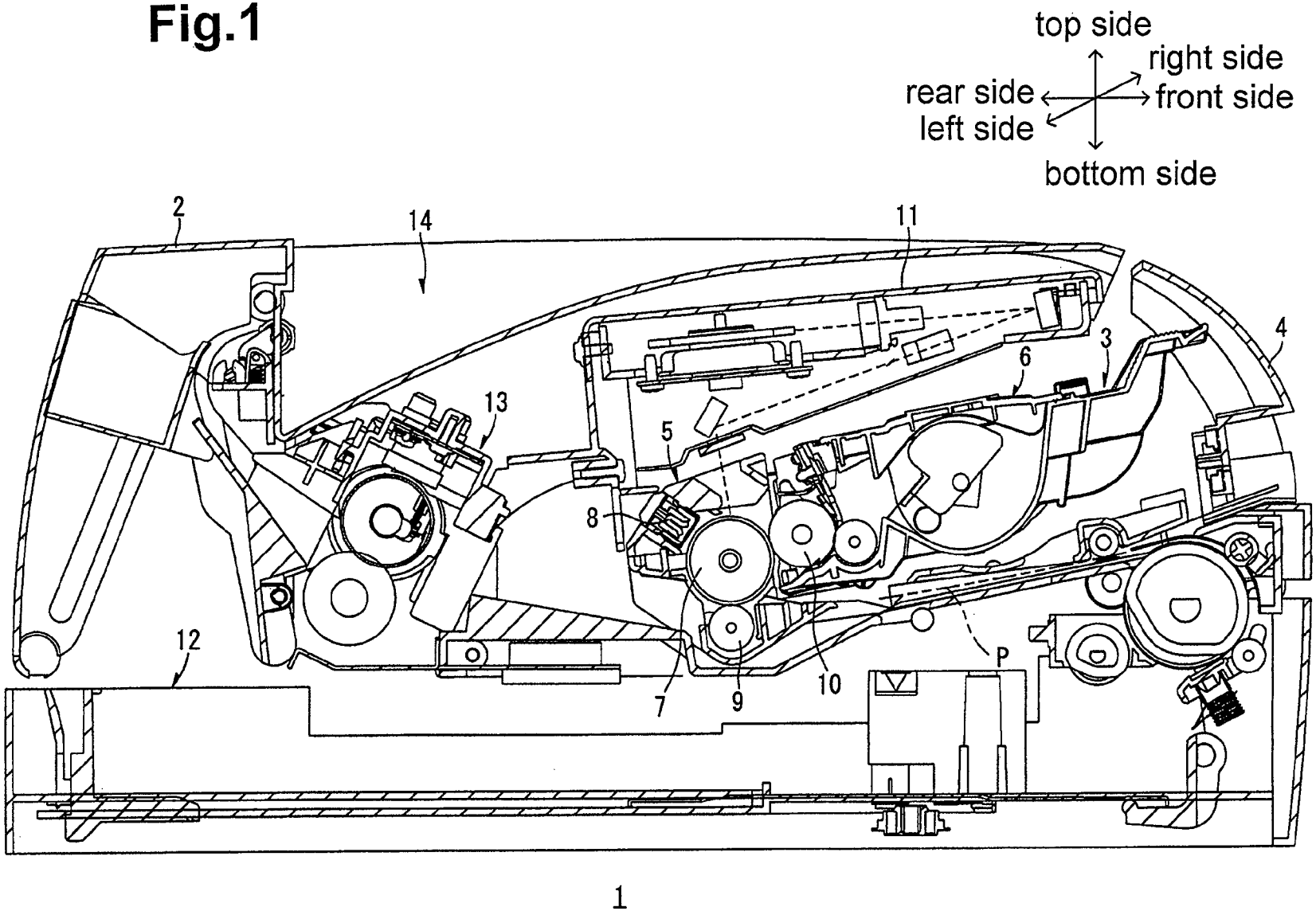
FIG. 1 is a side cross-sectional view of a printer according to a first embodiment of the invention.

FIG. 1 shows, in an embodiment of the invention, a laser printer 1, which is an exemplary image-forming apparatus. Laser printer 1 may comprise a body casing 2, which is an exemplary image-forming-apparatus body. The body casing 2 houses a process cartridge 3, which is an exemplary cartridge. The process cartridge 3 is mountable into and demountable from the body casing 2 in a state where a front cover 4 of the body casing 2 is opened.

Herein, the side of the body casing 2 on which the front cover 4 is provided may be referred to as the front side, and the opposite side may be referred to as the rear side. Accordingly, the front cover 4 is provided on the front of the body casing 2, as shown in FIG. 1. In addition, the right and the left refer to the respective sides when the laser printer 1 is seen from the front.

The process cartridge 3 may comprise a drum cartridge 5 and a development cartridge 6 removably mounted onto the drum cartridge 5 from the front side.

The drum cartridge 5 may comprise a photoconductor drum 7, which may be an exemplary rotatable member, rotatably provided thereinside. The drum cartridge 5 also may comprise a scorotron charger 8 and a transfer roller 9 around the photoconductor drum 7.

The development cartridge 6 may comprise a development roller 10. A portion of the peripheral surface of the development roller 10 may be exposed from the casing of the development cartridge 6, thereby being in contact with the photoconductor drum 7 from the front side.

A scanner unit 11 may be provided above the process cartridge 3. While the photoconductor drum 7 is rotated, the surface of the photoconductor drum 7 may be evenly charged by the scorotron charger 8. Subsequently, the photoconductor drum 7 is exposed with a laser beam emitted from the scanner unit 11. Thus, an electrostatic latent image is formed on the surface of the photoconductor drum 7. When the photoconductor drum 7 is further rotated and the electrostatic latent image faces the development roller 10, toner is supplied to the electrostatic latent image, whereby a toner image is formed on the surface of the photoconductor drum 7.

The body casing 2 houses at the bottom thereof a sheet cassette 12 in which pieces of paper P, which are exemplary recording sheets, may be placed. The pieces of paper P in the sheet cassette 12 are each conveyed by rollers to a transfer position defined between the photoconductor drum 7 and the transfer roller 9. When the toner image on the surface of the photoconductor drum 7 faces a piece of paper P, a transfer bias applied to the transfer roller 9 causes the toner image to be transferred onto the piece of paper P.

A fixing unit 13 may be provided on the rear side of the body casing 2, with respect to the process cartridge 3. The piece of paper P having the toner image transferred thereon may be conveyed to the fixing unit 13. In the fixing unit 13, the toner image is fixed on the piece of paper P with heat and pressure applied thereto. The piece of paper P having the toner image fixed thereon is discharged by rollers to a discharge tray 14, which may be provided at the top of the body casing 2.

2. Process Cartridge

Figure 2:
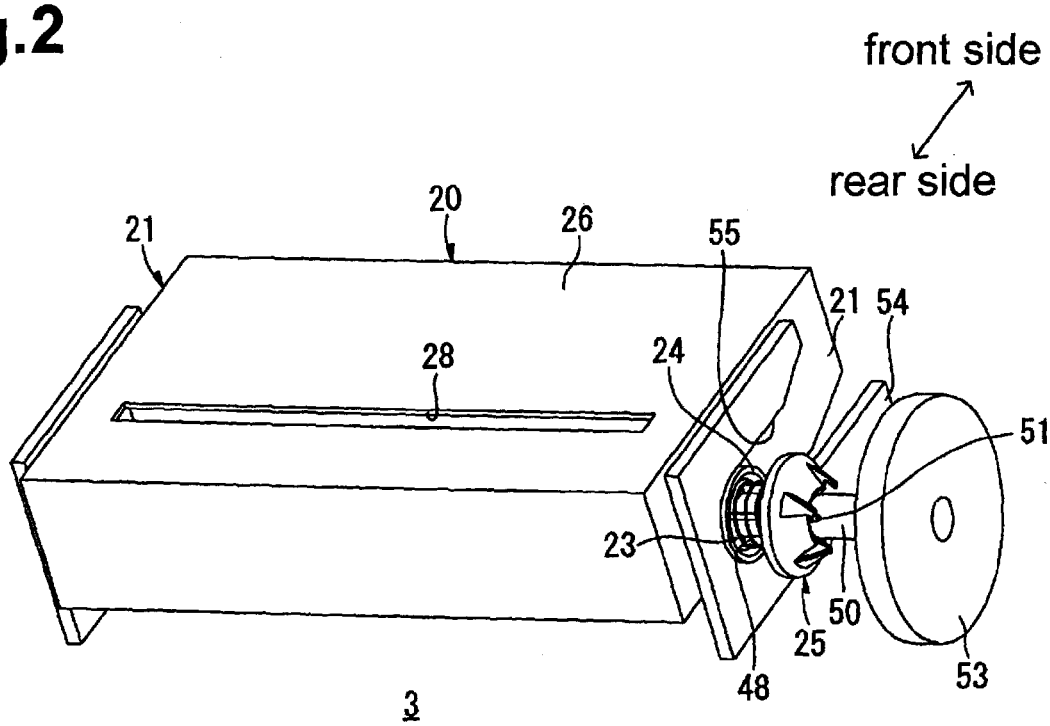
FIG. 2 is a perspective view showing a state where a process cartridge is mounted in a body casing, according to an embodiment of the invention.

Referring to FIG. 2, the process cartridge 3 may comprise a box-like casing 20. The casing 20 may comprise a pair of sidewalls 21 facing each other in the lateral direction. As shown in FIG. 1, the photoconductor drum 7 is rotatably held between the sidewalls 21. Referring again to FIG. 2, the sidewalls 21 may comprise collar members 24 disposed at the rear ends thereof. The collar members 24 may have substantially cylindrical shapes and may project laterally outward from the outer surfaces of the respective sidewalls 21. As shown in FIG. 10B, the ends of the photoconductor drum 7 may be fitted in the respective collar members 24 at the sidewalls 21 with bearing members 27 respectively interposed therebetween. Thus, the photoconductor drum 7 may be rotatably held between the sidewalls 21.

Referring again to FIG. 2, a top wall 26 extends between the upper ends of the sidewalls 21. The top wall 26 may have an oblong substantially rectangular slit 28 formed in a region facing the photoconductor drum, and extending in the axial direction of the photoconductor drum 7. As shown in FIGS. 1 and 2, in the state where the process cartridge 3 is mounted in the body casing 2, a laser beam emitted from the scanner unit 11 may be applied to the peripheral surface of the photoconductor drum 7 through the slit 28.

Figure 3:
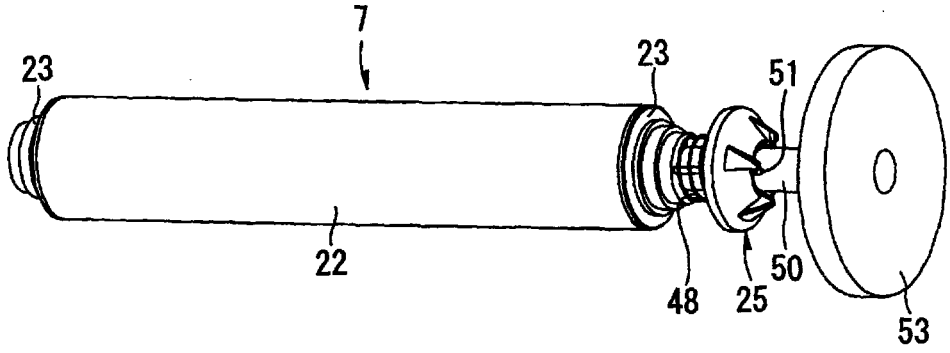
FIG. 3 is a perspective view showing a photoconductor drum, flange members, a drum-side coupling, and a body-side coupling, according to an embodiment of the invention.

Referring to FIG. 3, the photoconductor drum 7 may comprise a substantially cylindrical drum body 22 and right and left flange members 23 press-fitted to the respective ends of the drum body 22.

(1) Flange Members

Figure 4:
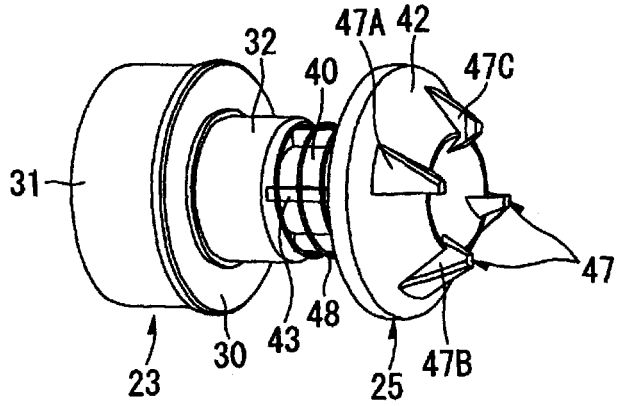
FIG. 4 is a perspective view showing one of the flange members and the drum-side coupling, according to an embodiment of the invention.

Referring to FIG. 4, the right flange member 23 may be an integrally formed body comprising a disc-like flange portion 30, a substantially cylindrical press-fitted portion 31 extending from one side of the flange portion 30, and a substantially cylindrical projecting portion 32 extending from the other side of the flange portion 30.

The flange portion 30 may have a diameter slightly larger than the inside diameter of the drum body 22 of the photoconductor drum 7. The press-fitted portion 31 may have an outside diameter substantially equal to the inside diameter of the drum body 22 of the photoconductor drum 7.

The projecting portion 32 may have an outside diameter smaller than that of the press-fitted portion 31. As shown in FIG. 1, in the state where the photoconductor drum 7 is mounted in the process cartridge 3, the projecting portion 32 is fitted in the collar member 24.

Figure 5:
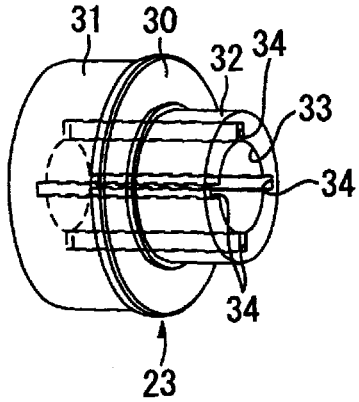
FIG. 5 is a perspective view of the flange member, according to an embodiment of the invention.
Figure 6:
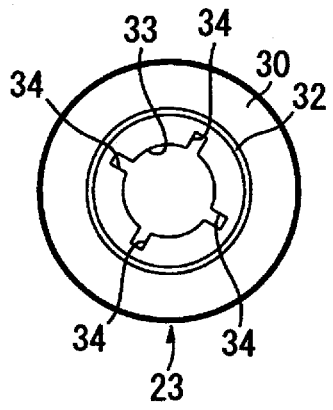
FIG. 6 is a side view of the flange member, according to an embodiment of the invention.

Referring to FIGS. 5 and 6, in an embodiment of the invention, the press-fitted portion 31 and the projecting portion 32 are integrally formed with the flange portion 30 interposed therebetween. In this configuration, the inner surface of the press-fitted portion 31 and the inner surface of the projecting portion 32 may form a communication path therethrough, with the flange portion 30 interposed therebetween. That is, the right flange member 23 may have a through-hole 33 passing through the flange portion 30, the press-fitted portion 31, and the projecting portion 32. In another embodiment of the invention, press-fitted portion 31, projecting portion 32, and flange portion 30 may be separate elements, and may be coupled together such that a communication path is formed therethrough.

The inner surface defining the through-hole 33 may include four receiving grooves 34, which may be exemplary grooves, formed at regular intervals, e.g., at 90-degree intervals therein. The receiving grooves 34 may be substantially rectangular cuts made in the inner surface defining the through-hole 33, and may be formed to specific depths in the radial direction of the press-fitted portion 31, and linearly extending in the direction in which the through-hole 33 extends. In another embodiment of the invention, the inner surface defining the through-hole 33 may have more or fewer receiving grooves than the four receiving grooves 34 shown in FIGS. 5 and 6.

Figure 8:
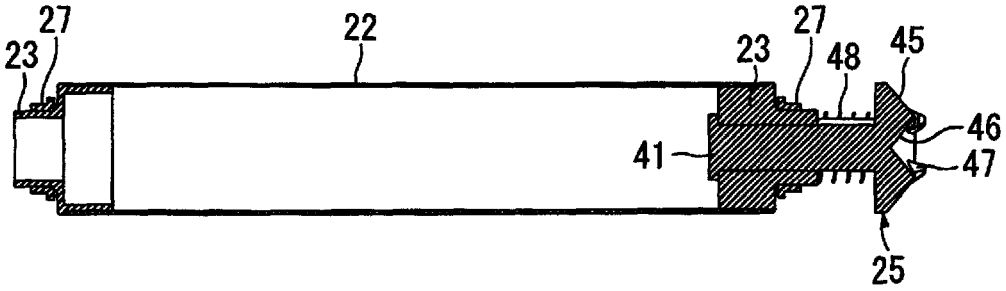
FIG. 8 is a cross-sectional view showing the photoconductor drum, the flange members, and the drum-side coupling, according to an embodiment of the invention.

As shown in FIG. 8, the press-fitted portion 31 of the right flange member 23 may be press-fitted into the right end of the drum body 22, thereby being attached to the photoconductor drum 7.

The left flange member 23 has substantially the same external shape as the right flange member 23. Specifically, the left flange member 23 may be an integrally formed body including a press-fitted portion press-fitted into the left end of the drum body 22, a flange portion configured to come into contact with the left end of the drum body 22, and a projecting portion projecting from the flange portion to the left. The left flange member 23 also may comprise a grounding member (not shown) through which the photoconductor drum 7 is grounded.

(2) Drum-Side Coupling

The right flange member 23 is provided with a drum-side coupling 25, e.g., a protruding member, which is an exemplary protruding member. The drum-side coupling 25 is advanceable and retractable in the axial direction of the photoconductor drum 7.

Figure 7:
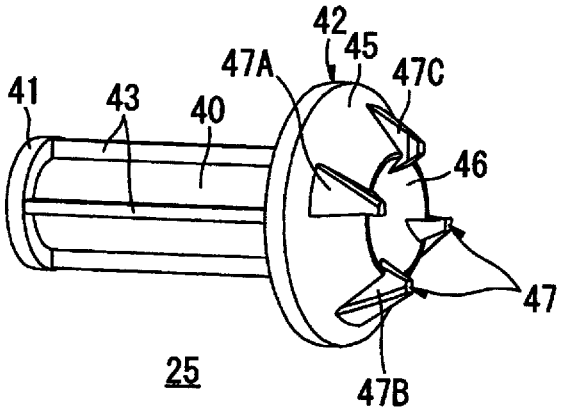
FIG. 7 is a perspective view of the drum-side coupling, according to an embodiment of the invention.

Referring to FIG. 7, the drum-side coupling 25 may be integrally formed, and may comprise a columnar inserted portion 40, a stopper 41 provided at one end of the inserted portion 40, and a body 42 provided at the other end of the inserted portion 40.

The inserted portion 40 may have an outside diameter substantially equal to the diameter of the through-hole 33 provided in the right flange member 23 and a length greater than the length of the through-hole 33. The inserted portion 40 may comprise four ridges 43 provided on the outer peripheral surface thereof at regular intervals, e.g., at 90-degree intervals in correspondence with the receiving grooves 34 formed in the inner surface defining the through-hole 33. The ridges 43 may comprise rectangular projections radially projecting from the outer peripheral surface of the inserted portion 40 and linearly extending in the direction in which the inserted portion 40 extends, with such a peripheral-direction width and an amount of projection as to be fitted in the corresponding receiving grooves 34.

The stopper 41 may have a substantially disc-like shape. The stopper 41 has the periphery thereof projecting outward, in a flange-like manner, with respect to the outer peripheral surface of the inserted portion 40.

The body 42 has a substantially frusto-conical shape tapered off from the end near the inserted portion 40. Specifically, referring to FIG. 8, the body 42 has on the outer peripheral surface thereof a particular sloping surface 45, e.g., a particular sloping surface 45 sloping toward the axis thereof from the base of body 42, e.g., the end connected to the inserted portion 40, to a tip of body 42 thereof. In an embodiment of the invention, the particular sloping surface 45 may slope at, for example, 45 degrees or more with respect to the axis of rotation of the drum-side coupling 25.

The body 42 also has a further sloping surface 46, e.g., a further sloping surface 46 sloping toward the axis thereof from a tip of the particular sloping surface 45 toward the base of the body 42. The further sloping surface 46 may slope at, for example, 45 degrees or more with respect to the axis of rotation of the drum-side coupling 25. In an embodiment of the invention, the body 42 may have additional sloping surfaces similar to the particular sloping surface 45 and the further sloping surface 46, such that the body 42 may have a substantially W-shaped cross section with the particular and further sloping surfaces 45 and 46.

Figure 9:
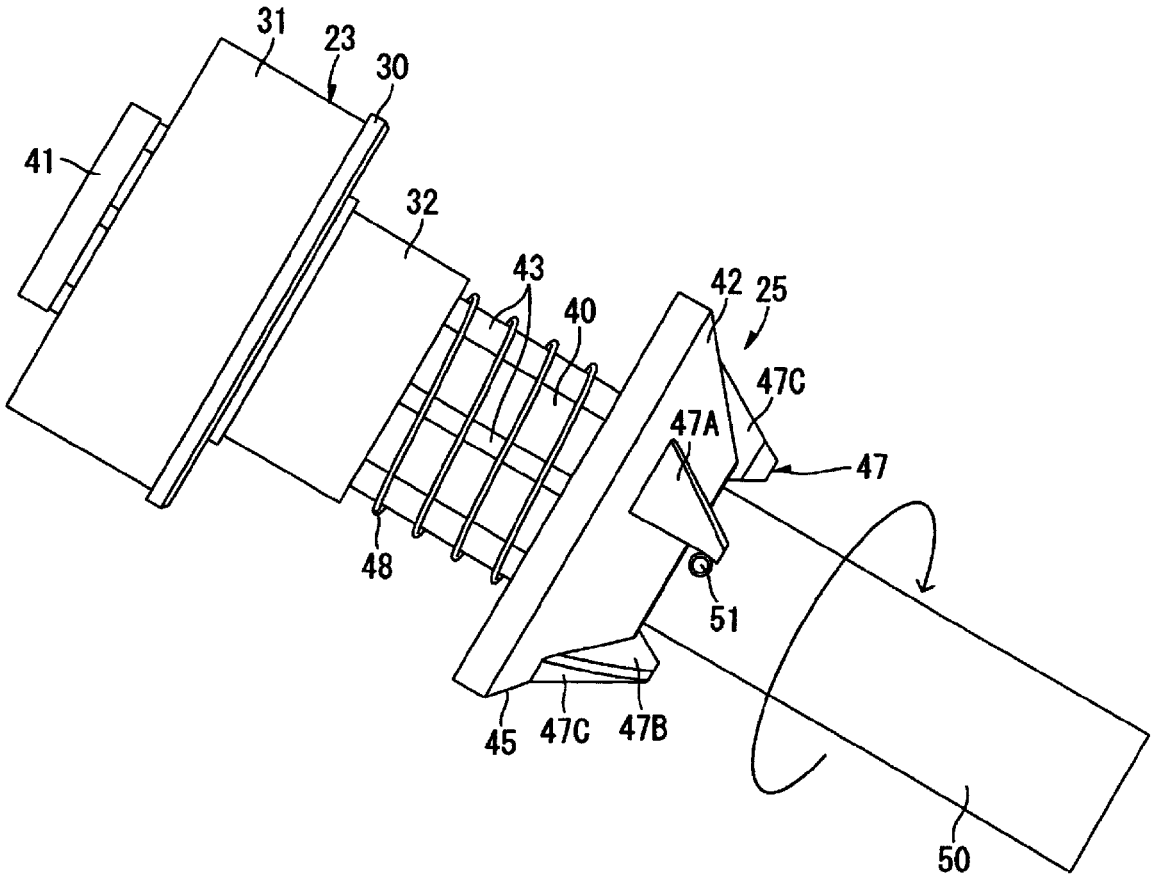
FIG. 9 is a plan view showing the drum-side coupling and the body-side coupling engaging with each other, according to an embodiment of the invention.

Referring to FIGS. 8 and 9, The body 42 also may comprise four pawls 47 projecting from the outer peripheral surface thereof. The pawls 47 may be provided on the outer peripheral surface, e.g., the particular sloping surface 45 of the body 42, and may be arranged at regular intervals, e.g., at 90-degree intervals in the peripheral direction. The particular sloping surface 45 faces outwardly with regard to radial direction orthogonal to the axis. Referring to FIG. 9, the pawls 47 each have a particular surface 47A extending in the peripheral direction of the body 42, a further surface 47B facing the downstream side in the direction of rotation of the body 42, and a third surface 47C facing the upstream side in the direction of rotation of the body 42, thereby having the shape of a substantially triangular pyramid. Referring to FIG. 9, the tip of the third surface 47C of each pawl 47 slopes with respect to the axis of the body 42.

As shown in FIGS. 4 to 9, the inserted portion 40 of the drum-side coupling 25 may be inserted into the through-hole 33 of the flange member 23, whereby the drum-side coupling 25 is attached to the flange member 23 in such a manner as to allow the drum-side coupling 25 to advance and retract with respect to the flange member 23. In this state, the body 42 of the drum-side coupling 25 may be positioned on the outside of the collar member 24 of the sidewall 21. In an embodiment of the invention, the drum-side coupling 25 extends further outward than the collar member 24 and the sidewall 21 at the most retracted position of the drum-side coupling in a state where the cartridge is being mounted.

The ridges 43 of the inserted portion 40 may be fitted in the receiving grooves 34 of the flange member 23. Thus, the ridges 43 and the receiving grooves 34 may correspond with the position of the drum-side coupling 25 in the peripheral direction. The ridges 43 and the receiving grooves 34 may prevent drum-side coupling 25 from rotating independently of flange member 23, e.g., ridges 43 of the inserted portion 40 may not rotate without also rotating receiving grooves 34 of flange member 23, when ridges 43 are fitted into receiving grooves 34. Therefore, when a driving force is input to the drum-side coupling 25, a force acting in the peripheral direction, e.g., the direction of rotation is assuredly transmitted from the drum-side coupling 25 to the flange member 23.

The ridges 43 and the receiving grooves 34 may extend along the axes of the flange member 23 and the drum-side coupling 25, e.g., the axis of the photoconductor drum 7, respectively. Thus, the ridges 43 and the receiving grooves 34 do not prevent drum-side coupling 25 from moving in the axial direction. The movement of the drum-side coupling 25 in the axial direction is limited by the stopper 41, which is configured to come into contact with the flange member 23 when the drum-side coupling 25 is fully retracted.

(3) Coil Spring

Referring to FIG. 3, a coil spring 48, which is an exemplary urging member, may be provided between the flange member 23 and the drum-side coupling 25. The coil spring 48 configured to always be in a contracted state when positioned between flange member 23 and drum-side coupling 25. Thus, coil spring 48 constantly applies a force for urging the drum-side coupling 25 in a direction away from the flange member 23.

3. Body Casing

Referring to FIG. 2, the body casing 2 may be provided with a body-side coupling 50, which is an exemplary driving member.

Referring to FIG. 10B, the body-side coupling 50 may be a columnar body having a conical tip that fits the further sloping surface 46 of the drum-side coupling 25. The body-side coupling 50 has two projections 51 projecting in directions that are orthogonal to the axis of rotation thereof. The projections 51 may be arranged at regular intervals (180-degree intervals) in the peripheral direction of the body-side coupling 50. In another embodiment of the invention, there may be greater than two projections 51.

The body-side coupling 50 may be connected to a driving gear 53. When a rotational driving force is input to the driving gear 53 from a motor (not shown) provided in the body casing 2, the body-side coupling 50 may rotate.

The body casing 2 may be provided with a pair of body side plates 54 facing each other in the width direction (the direction along the axis of the photoconductor drum 7 in the state where the process cartridge 3 may be mounted in the body casing 2, e.g., as shown in FIG. 1). The body side plates 54 each, may have a plate-like shape extending in the direction in which the process cartridge 3 is mounted/demounted.

The body side plates 54 each may have a guide portion 55. The guide portion 55 may be a cut made from the upstream side toward the downstream side in a mounting direction in which the process cartridge 3 is mounted, and thus has a substantially U shape in side view. The guide portion 55 may have a width substantially equal to the outside diameter of the collar member 24.

By moving the process cartridge 3 positioned between the pair of body side plates 54 with the collar members 24 being in contact with the respective guide portions 55, the process cartridge 3 can be mounted into and demounted from the body casing 2.

4. Mounting and Demounting of Process Cartridge into and from Body Casing

Referring mainly to FIGS. 10A to 13B, mounting and demounting of the process cartridge 3 into and from the body casing 2 will now be described. Herein, the upstream side in the mounting direction in which the process cartridge 3 is mounted into the body casing 2 is referred to as the front side, and the opposite side (the downstream side in the mounting direction) is referred to as the rear side, e.g., as shown in FIG. 1.

(1) Mounting

Figure 10A:
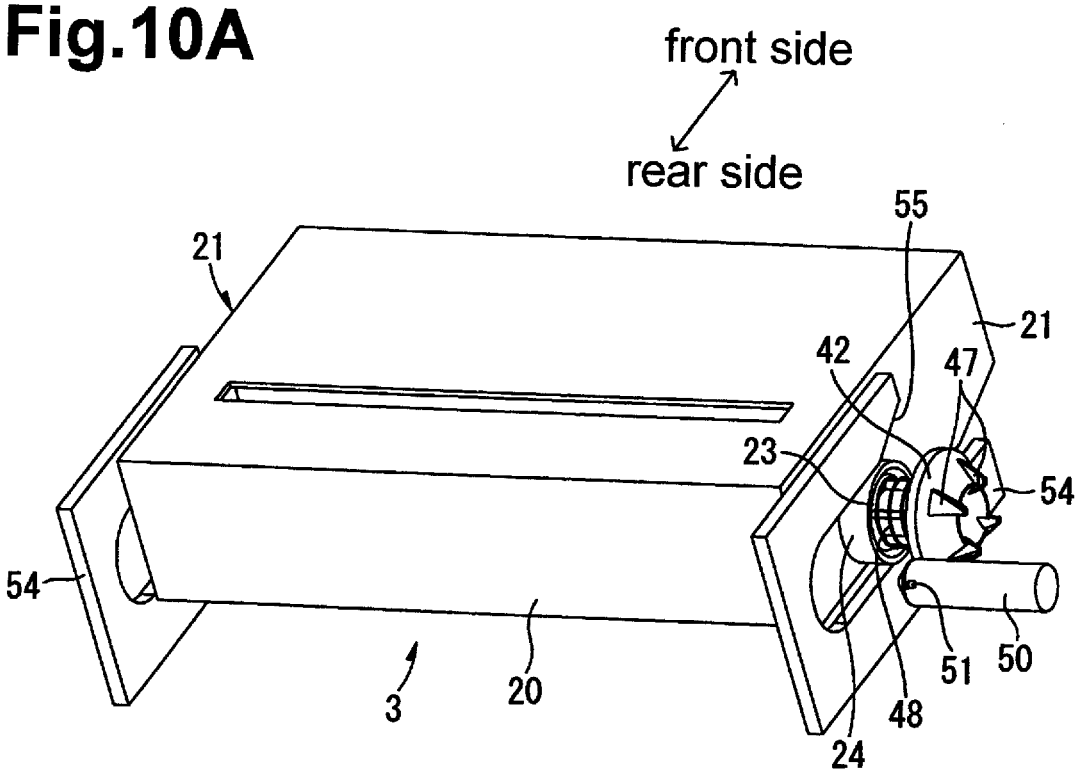
FIG. 10A is a perspective view of the process cartridge in a state before being mounted in the body casing, according to an embodiment of the invention.
Figure 10B:
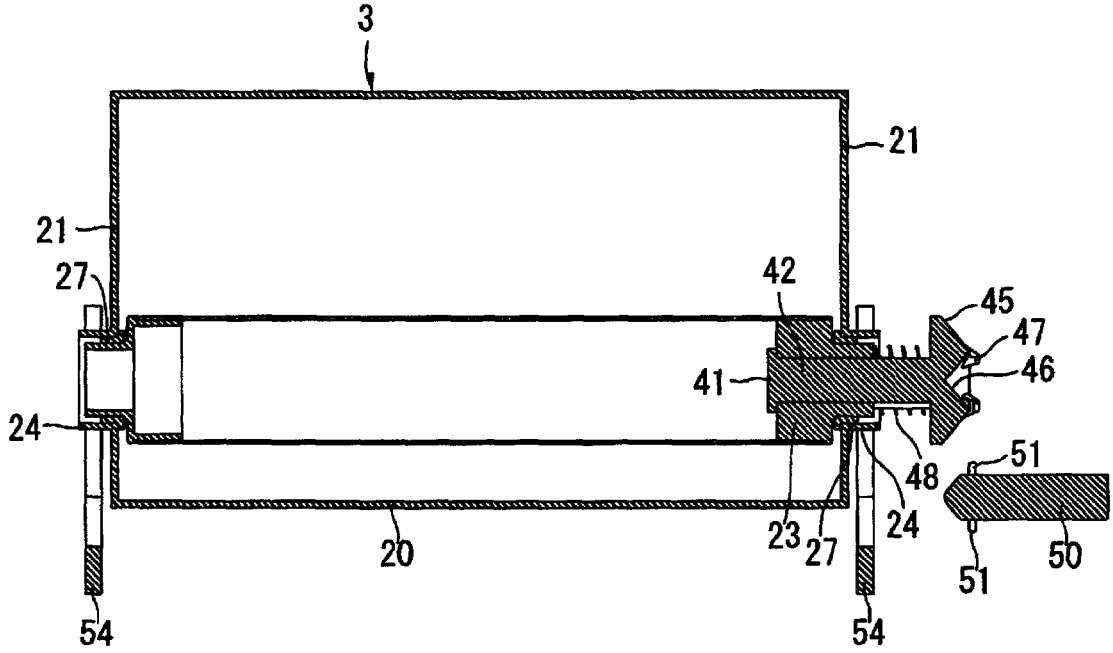
FIG. 10B is a cross-sectional view of the process cartridge shown in FIG. 10A, taken along a plane extending through the drum-side coupling and the body-side coupling, according to an embodiment of the invention.

Referring to FIGS. 10A and 10B, the process cartridge 3 may be first positioned between the body side plates 54 of the body casing 2. In this state, the right and left collar members 24 may be positioned at the front-side ends of the guide portions 55 of the body side plates 54, the body 42 of the drum-side coupling 25 may face the body-side coupling 50 from the front side, the drum-side coupling 25 may be urged by the coil spring 48 in an advancing direction (the direction in which the body 42 moves away from the flange member 23), and the stopper 41 of the drum-side coupling 25 is in contact with the flange member 23.

Figure 11A:
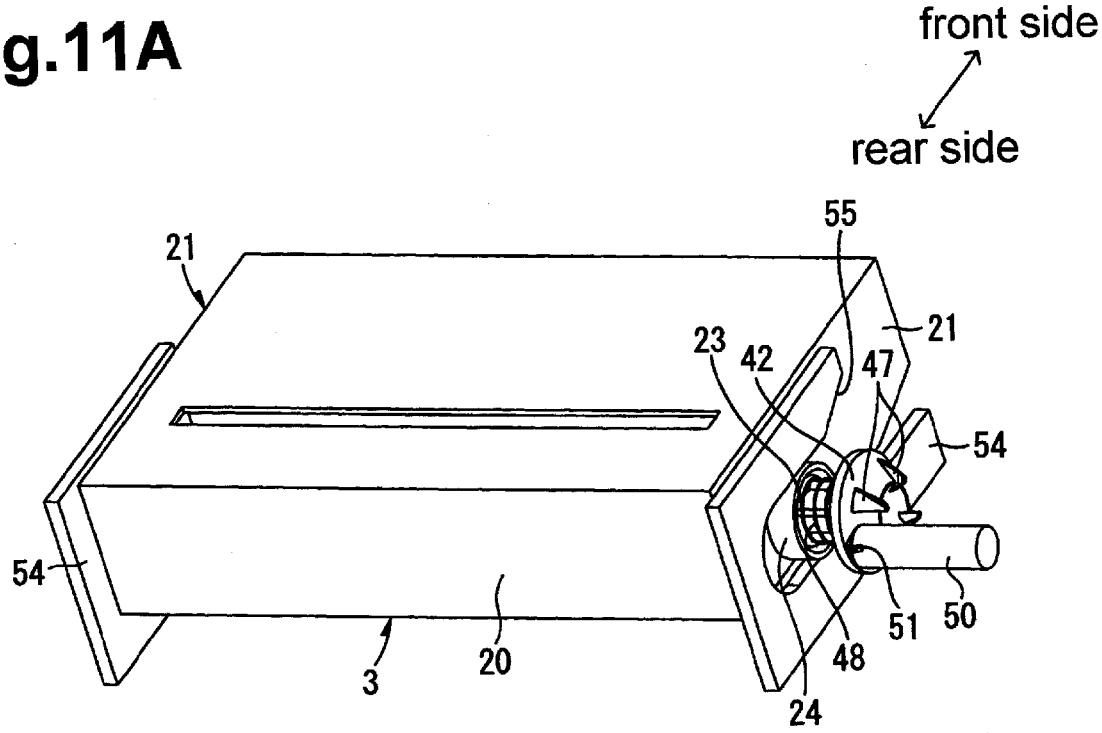
FIG. 11A is a perspective view of the process cartridge in a state during being mounted into the body casing, according to an embodiment of the invention.
Figure 11B:
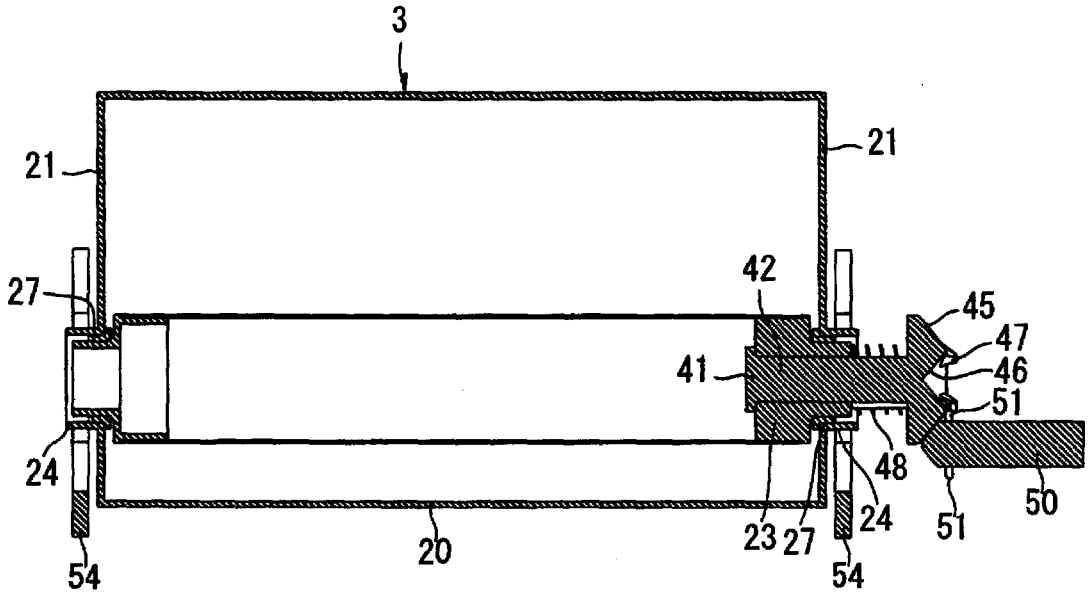
FIG. 11B is a cross-sectional view of the process cartridge shown in FIG. 11A, taken along the plane extending through the drum-side coupling and the body-side coupling, according to an embodiment of the invention.

Referring to FIGS. 11A and 11B, When the process cartridge 3 is moved toward the rear side, the right and left collar members 24 may be guided toward the rear side along the guide portions 55, and the particular sloping surface 45 of the body 42 of the drum-side coupling 25 may come into contact with the tip of the body-side coupling 50.

When the process cartridge 3 is further moved toward the rear side, a force acting in the mounting direction may be applied from the body-side coupling 50 to the particular sloping surface 45. The force may include a retracting component that acts in a retracting direction in which the drum-side coupling 25 retracts and an orthogonal component that is orthogonal to the retracting component. Therefore, referring now to FIGS. 12A and 12B, the drum-side coupling 25 may receive the retracting component and may retract against the urging force of the coil spring 48. As shown in FIG. 7 and FIG. 5, during this movement, the ridges 43 of the inserted portion 40 of the drum-side coupling 25 may slide along the receiving grooves 34 in the surface defining the through-hole 33 of the flange member 23.

Figure 12A:
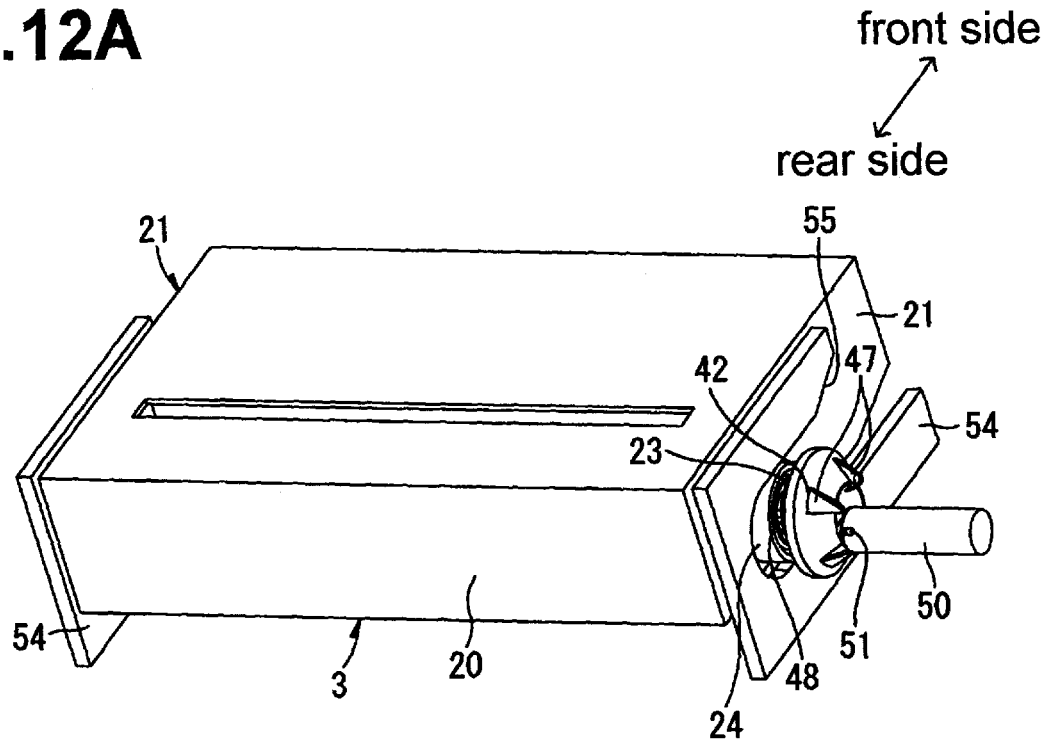
FIG. 12A is a perspective view of the process cartridge in a state after the state shown in FIG. 11A, according to an embodiment of the invention.
Figure 12B:
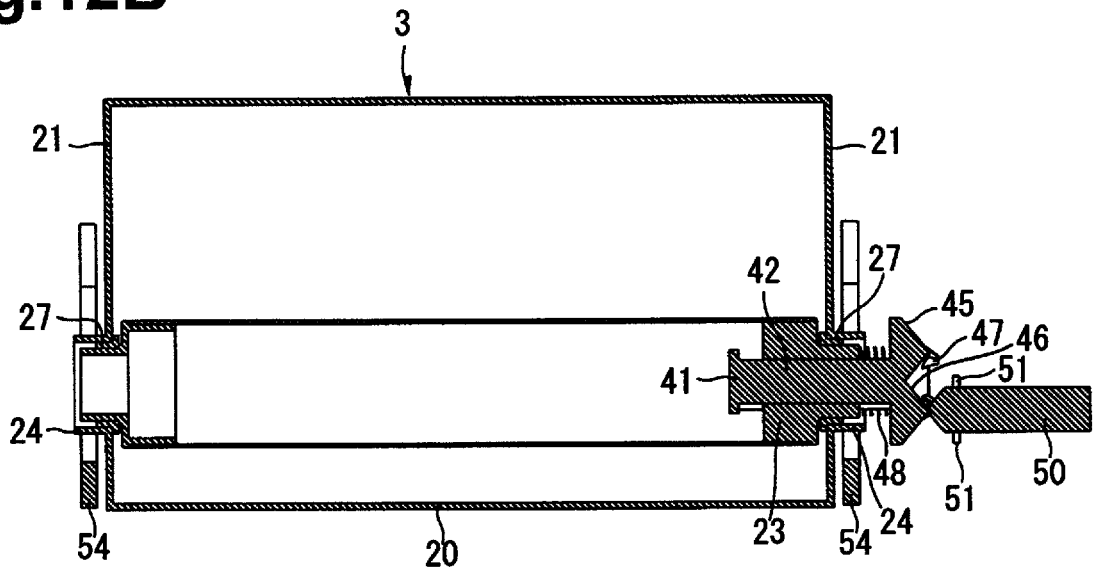
FIG. 12B is a cross-sectional view of the process cartridge shown in FIG. 12A, taken along the plane extending through the drum-side coupling and the body-side coupling, according to an embodiment of the invention.

As shown in FIGS. 12A and 12B, the drum-side coupling 25 receives the retracting component and retracts against the urging force of the coil spring 48. As shown in FIGS. 12A and 12B, the particular sloping surface of drum-side coupling 25 slides along body-side coupling 50. Thus, in an embodiment of the invention, the amount of retraction of drum-side coupling 25 is determined by the slope, with respect to the direction orthogonal to the axis of rotation of the protruding member, of the particular sloping surface.

Figure 13A:
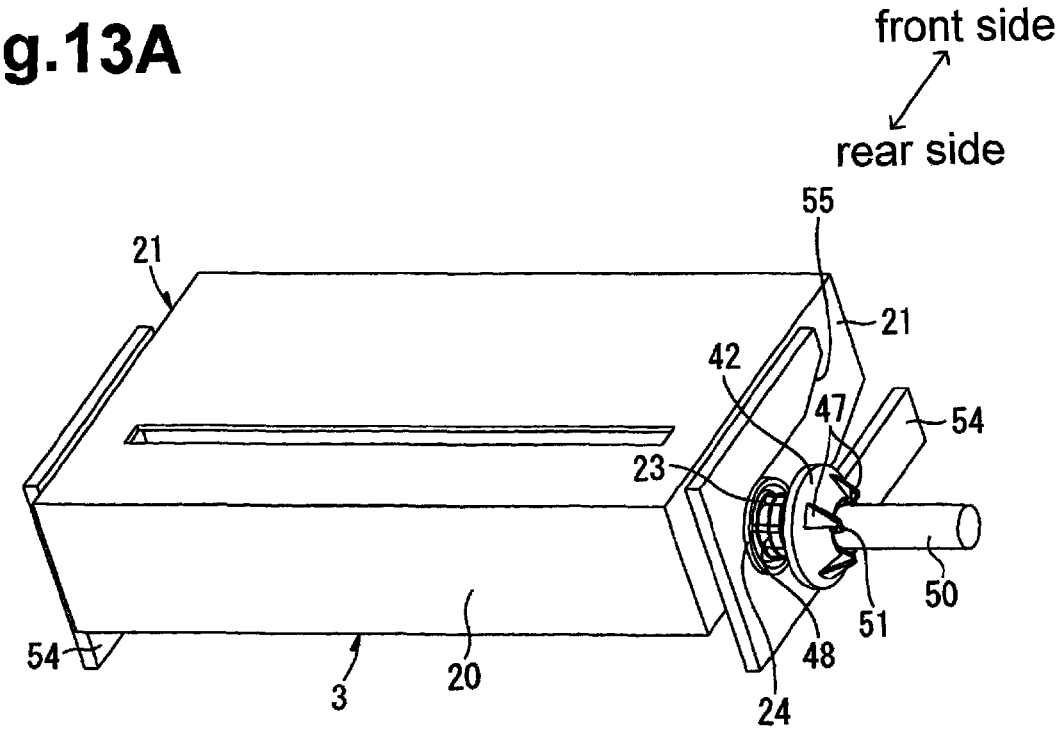
FIG. 13A is a perspective view of the process cartridge in a state where the mounting of the process cartridge into the body casing is completed, according to an embodiment of the invention.
Figure 13B:
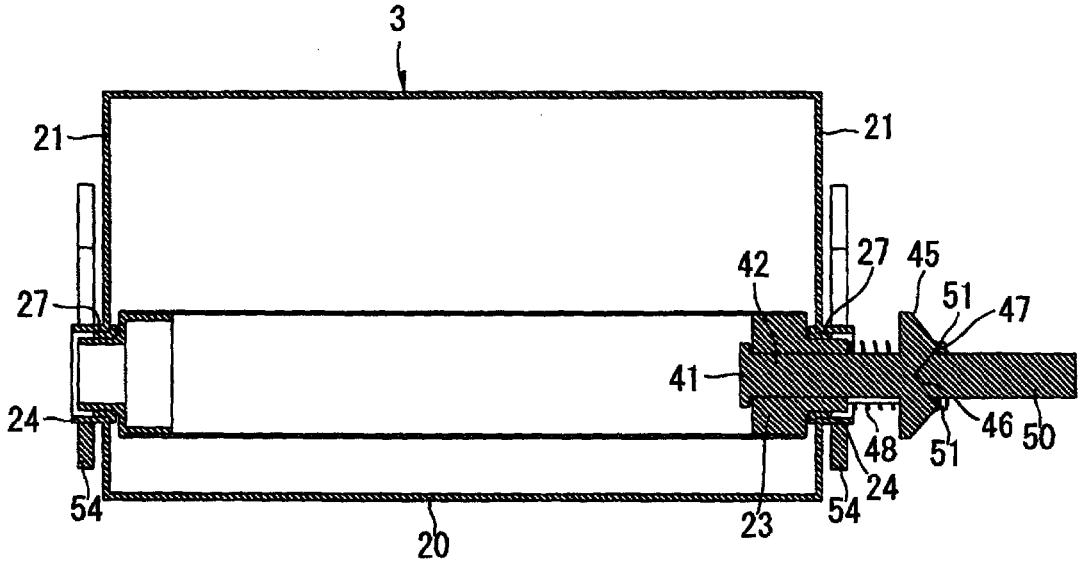
FIG. 13B is a cross-sectional view of the process cartridge shown in FIG. 13A, taken along the plane extending through the drum-side coupling and the body-side coupling, according to an embodiment of the invention.

Referring now to FIGS. 13A and 13B, when the process cartridge 3 is further moved toward the rear side, the drum-side coupling 25 may further retract to such a position as not to face the body-side coupling 50 in the mounting direction. Thus, the tip of the body-side coupling 50 may separate from the particular sloping surface 45 and may smoothly come into contact with the further sloping surface 46. At the same time, the pressing force (the retracting component) that has been applied from the body-side coupling 50 to the drum-side coupling 25 is reduced, whereby the drum-side coupling 25 advances with the urging force of the coil spring 48. In this state, the body 42 (the further sloping surface 46) and the body-side coupling 50 may be in contact with each other with the stopper 41 being very close, but not in contact with the flange member 23. Thus, engagement of the body-side coupling 50 with the drum-side coupling 25 is completed.

Meanwhile, the collar members 24 may come into contact with the rear-side ends of the guide portions 55 of the body side plates 54, whereby further movement of the process cartridge 3 toward the rear side is prevented. Thus, mounting of the process cartridge 3 into the body casing 2 is completed.

In the state shown in FIG. 9 where the body-side coupling 50 may engage with the drum-side coupling 25, the projections 51 of the body-side coupling 50 may be in contact with corresponding ones of the pawls 47 of the body 42 of the drum-side coupling 25 from the upstream side in the direction of rotation of the body-side coupling 50 (the direction of the arrow shown in FIG. 9). The tips of the third surfaces 47C (the surfaces on the upstream side in the foregoing direction of rotation) of the pawls 47 slope with respect to the axis of the body 42. When the projections 51 are caught by the pawls 47, forces acting in the foregoing direction of rotation may be applied from the projections 51 to the third surfaces 47C. The forces each may include an advancing component acting along the axis of the body 42 and a component orthogonal to the advancing component. Accordingly, the advancing component may be applied to the drum-side coupling 25 from the pawls 47.

(2) Demounting

The process cartridge 3 may be demounted from the body casing 2 by performing the above mounting procedure in the reverse order.

Specifically, referring to FIGS. 13A and 13B, when the process cartridge 3 mounted in the body casing 2 is pulled toward the front side, a force acting in a demounting direction may be applied from the body-side coupling 50 to the further sloping surface 46. The force may include a retracting component that acts in the retracting direction in which the drum-side coupling 25 retracts and an orthogonal component that is orthogonal to the retracting component. Therefore, referring now to FIGS. 12A and 12B, the drum-side coupling 25 may receive the retracting component and may retract against the urging force of the coil spring 48. As shown in FIG. 5 and FIG. 7 during this movement, the ridges 43 of the inserted portion 40 of the drum-side coupling 25 may slide along the receiving grooves 34 in the surface defining the through-hole 33 of the flange member 23.

Referring now to FIGS. 11A and 11B, when the process cartridge 3 is further pulled toward the front side, the drum-side coupling 25 may further retract to such a position as not to face the body-side coupling 50 in the demounting direction. Thus, the tip of the body-side coupling 50 may separate from the further sloping surface 46 and may smoothly come into contact with the particular sloping surface 45. At the same time, the pressing force (the retracting component) that has been applied from the body-side coupling 50 to the drum-side coupling 25 may be reduced, whereby the drum-side coupling 25 advances with the urging force of the coil spring 48. Consequently, the stopper 41 may come into contact with the flange member 23, preventing further advancement of the drum-side coupling 25.

When the process cartridge 3 is further pulled toward the front side, the process cartridge 3 may separate from the pair of body side plates 54. Thus, demounting of the process cartridge 3 from the body casing 2 is completed.

5. Advantages

Thus, the drum-side coupling 25 may be configured to be advanceable and retractable with a configuration utilizing the particular sloping surface 45 of the drum-side coupling 25 without providing in the body casing 2 any additional members for causing the drum-side coupling 25 to advance and retract, whereby engagement between the drum-side coupling 25 and the body-side coupling 50 is realized.

The drum-side coupling 25 also may have the further sloping surface 46 configured to be in contact with the body-side coupling 50 in the state where the drum-side coupling 25 engages with the body-side coupling 50. The further sloping surface 46 slopes with respect to the directions parallel to and orthogonal to the axis of rotation of the drum-side coupling 25.

When the process cartridge 3 starts to be moved in the demounting direction relative to the body casing 2, the body-side coupling 50 comes into contact with the further sloping surface 46. When the process cartridge 3 is further moved in the demounting direction relative to the body casing 2, the force acting in the direction of the contact is converted by the further sloping surface 46 into a force (the retracting component) acting in the direction parallel to the axis of rotation. This retracting component causes the drum-side coupling 25 to retract from the body-side coupling 50 against the urging force of the coil spring 48. Thus, the drum-side coupling 25 is configured to be retractable from the body-side coupling 50 when the process cartridge 3 is demounted from the body casing 2, with a configuration utilizing the further sloping surface 46 of the drum-side coupling 25.

The further sloping surface 46 may slope at 45 degrees or more with respect to the direction parallel to the axis of rotation of the drum-side coupling 25. The force applied from the body-side coupling 50 to the further sloping surface 46 when the body-side coupling 50 comes into contact with the further sloping surface 46 includes a retracting component and an orthogonal component orthogonal to the retracting component. If the further sloping surface 46 slopes at 45 degrees or more, the retracting component is larger than the orthogonal component. Therefore, when the process cartridge 3 is demounted from the body casing 2, the drum-side coupling 25 is caused to retract from the body-side coupling 50 without a large force.

The particular sloping surface 45 may slope at 45 degrees or more with respect to the direction parallel to the axis of rotation of the drum-side coupling 25. The force applied from the body-side coupling 50 to the particular sloping surface 45 when the body-side coupling 50 comes into contact with the particular sloping surface 45 includes a retracting component and an orthogonal component orthogonal to the retracting component. If the particular sloping surface 45 slopes at 45 degrees or more, the retracting component may be larger than the orthogonal component. Therefore, when the process cartridge 3 is mounted into the body casing 2, the drum-side coupling 25 is caused to retract from the body-side coupling 50 without a large force.

The body-side coupling 50 may have the projections 51 projecting in respective directions orthogonal to the axis of rotation thereof. The drum-side coupling 25 may have the pawls 47 configured to come into contact with the projections 51 when the body-side coupling 50 is rotated while engaging with the drum-side coupling 25. Thus, when the body-side coupling 50 is rotated, the rotational force is assuredly transmitted to the drum-side coupling 25 through the projections 51 and the pawls 47.

The tips of the third surfaces 47C at which the pawls 47 come into contact with the projections 51 may slope toward the axis of rotation of the drum-side coupling 25. Therefore, when the body-side coupling 50 is rotated and the projections 51 come into contact with the third surfaces 47C of the pawls 47, forces acting in the direction of rotation are applied from the projections 51 to the third surfaces 47C. Because of the sloping tips of the third surfaces 47C, the forces each include an advancing component acting in the direction parallel to the axis of the body 42 and a component orthogonal to the advancing component. With the advancing component and with the pawls 47 and the drum-side coupling 25, the position of the photoconductor drum 7 in the axial direction is determined.

6. Second Embodiment

Figure 14:
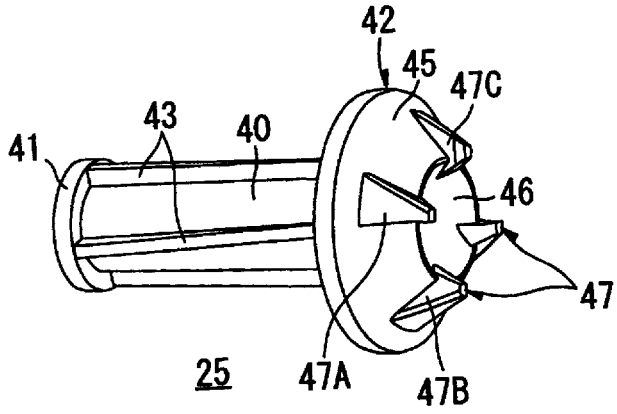
FIG. 14 is a perspective view of a drum-side coupling according to a second embodiment of the present invention.

Referring to FIG. 14, the ridges 43 of the inserted portion 40 may be twisted in the direction of rotation.

Specifically, in a second embodiment of the present invention, the ridges 43 may be twisted such that the ends thereof near the body 42 are positioned on the downstream side in the direction of rotation with respect to the ends thereof near the stopper 41, thereby forming helical splines.

Figure 15:
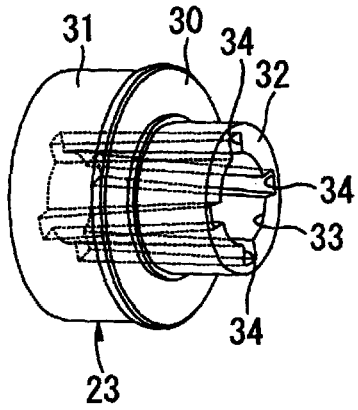
FIG. 15 is a perspective view of a flange member according to the second embodiment of the present invention.
Figure 16:
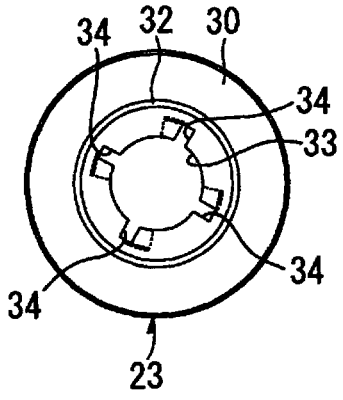
FIG. 16 is a side view of the flange member shown in FIG. 15.

As shown in FIGS. 15 and 16, in correspondence with the ridges 43, the receiving grooves 34 formed in the surface defining the through-hole 33 of the flange member 23 may be also twisted such that the ends thereof near the projecting portion 32 are positioned on the downstream side in the direction of rotation with respect to the ends thereof near the press-fitted portion 31.

To summarize, in the second embodiment described above, the photoconductor drum 7 may have at one end thereof the cylindrical flange member 23. The drum-side coupling 25 may have the inserted portion 40 inserted into the flange member 23. The inserted portion 40 may have on the outer surface thereof the ridges 43 extending in the advancing direction in which the drum-side coupling 25 advances while being twisted in the direction of rotation of the drum-side coupling 25. The flange member 23 may have in the inner surface thereof the receiving grooves 34 into which the ridges 43 are fitted. Thus, when a rotational force is input to the drum-side coupling 25, a force acting in the direction of rotation may be applied from the ridges 43 to the receiving grooves 34. Because of the twisting of the receiving grooves 34 and the ridges 43, the force includes a component acting in the direction parallel to the axis of the photoconductor drum 7 and a component orthogonal to the foregoing component. With the component acting in the direction parallel to the axis of the photoconductor drum 7 and with the flange member 23, the photoconductor drum 7 is positioned on one side in the axial direction thereof.

7. Variation

Embodiments of the present invention have been described above, however, the invention may be embodied in other forms and other embodiments. For example, in another embodiment, the receiving grooves 34 may be wider than the ridges 43 in the peripheral direction. In this embodiment, the ridges 43 may be received by the receiving grooves 34 with some play in the peripheral direction, e.g., the ridges 43 may have a small range of motion independently of receiving grooves 34. Therefore, the advancing and retracting movements of the inserted portion 40 in the through-hole 33 may be realized smoothly.

The above embodiments describe the process cartridge 3 as an exemplary cartridge, however, the development cartridge 6 may also be configured as another exemplary cartridge. In the case of the development cartridge 6, the development roller 10 provided in the development cartridge 6 may function as an exemplary rotatable member, and a development-roller-side coupling configured to input a driving force to the development roller 10 may function as an exemplary protruding member.

While the above exemplary configurations each include two projections 51 at the tip of the body-side coupling 50, in another embodiment, four projections 51 may alternatively be provided at regular intervals, e.g., 90 degree intervals, in the peripheral direction of the body-side coupling 50. While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A cartridge comprising:

a casing;

a rotatable member rotatably supported by the casing;

a protruding member configured to advance and retract in directions parallel to an axis of rotation of the rotatable member; and an urging member configured to urge the protruding member to advance in an advancing direction, wherein the protruding member has a particular sloping surface configured to be contacted by a driving member of an apparatus body in a direction orthogonal to an axis of rotation of the protruding member when the cartridge is mounted into the apparatus body, and the particular sloping surface slopes with respect to directions parallel to and orthogonal to the axis of rotation of the protruding member, wherein the rotatable member comprises a cylindrical flange member disposed at one end thereof, wherein the protruding member comprises an inserted portion configured to be inserted into the flange member, wherein the inserted portion comprises a ridge disposed on an outer surface thereof, the ridge extending in the advancement direction, and wherein the ridge is twisted in a direction of rotation of the protruding member, and wherein the flange member has a groove formed in an inner surface therein, and the ridge is configured to be fitted into the groove.

2. The cartridge according to claim 1, wherein the driving member of the apparatus body is configured to engage with the protruding member, and the protruding member and the driving member are configured to rotate together.

3. The cartridge according to claim 1, wherein the protruding member has a further sloping surface, wherein the further sloping surface slopes with respect to the directions parallel to and orthogonal to the axis of rotation of the protruding member, and the further sloping surface slopes in an opposite direction as the particular sloping surface in the directions orthogonal to the axis and the further sloping surface slopes in a same direction from the particular sloping surface in the directions parallel to the axis of rotation of the protruding member.

4. The cartridge according to claim 3, wherein the cartridge is configured to be mounted into an apparatus body, and the particular sloping surface is configured to contact a driving member of the apparatus body, and the further sloping surface is configured to contact the driving member of the apparatus body in a state in which the driving member engages with the protruding member.

5. The cartridge according to claim 3, wherein the further sloping surface slopes at least 45 degrees with respect to the direction parallel to the axis of rotation of the protruding member.

6. The cartridge according to claim 1, wherein the particular sloping surface slopes at least 45 degrees with respect to the direction parallel to the axis of rotation of the protruding member.

7. The cartridge according to claim 3, wherein the driving member has at least one projection that extends in a direction orthogonal to an axis of rotation of the protruding member, and wherein the protruding member has at least one engagement protrusion, wherein each of the at least one projections is configured to contact a corresponding one of the at least one engagement protrusions when the driving member rotates the protruding member.

8. The cartridge according to claim 7, wherein each of the at least one engagement protrusions comprises a particular surface that slopes with respect to the axis of rotation of the protruding member, and wherein a tip of each particular surface is configured to contact a corresponding projection when the driving member rotates the protruding member.

9. The cartridge according to claim 1, wherein the particular sloping surface faces outwardly with regard to radial direction orthogonal to the axis.

10. A cartridge comprising:

a casing;

a rotatable member rotatably supported by the casing;

a protruding member configured to advance and retract in directions parallel to an axis of rotation of the rotatable member; and an urging member configured to urge the protruding member in an advancing direction, wherein the protruding member has a particular sloping surface, the particular sloping surface slopes with respect to directions parallel to and orthogonal to the axis of rotation of the protruding member, and wherein the protruding member is configured to retract and advance by an amount corresponding to a slope, with respect to the direction orthogonal to the axis of rotation of the protruding member, of the particular sloping surface.

11. The cartridge according to claim 10, wherein the cartridge is configured to be mounted into an apparatus body, and the particular sloping surface is configured to contact a driving member of the apparatus body.

12. The cartridge according to claim 11, wherein the driving member of the apparatus body is configured to engage with the protruding member, and the protruding member and the driving member are configured to rotate together.

13. The cartridge according to claim 10, wherein the protruding member has a further sloping surface, wherein the further sloping surface slopes with respect to the directions parallel to and orthogonal to the axis of rotation of the protruding member, and the further sloping surface slopes in an opposite direction as the particular sloping surface in the directions orthogonal to the axis and the further sloping surface slopes in a same direction from the particular sloping surface in the directions parallel to the axis of rotation of the protruding member.

14. The cartridge according to claim 13, wherein the protruding member is configured to retract by an amount corresponding to a slope of the particular sloping surface, and to advance by an amount corresponding to a slope of the further sloping surface.

15. The cartridge according to claim 13, wherein the cartridge is configured to be mounted into an apparatus body, and the particular sloping surface is configured to contact a driving member of the apparatus body, and the further sloping surface is configured to contact the driving member of the apparatus body in a state in which the driving member engages with the protruding member.

* * * * *